United States Patent [19]

Dunagan

[11] 4,169,033

[45] Sep. 25, 1979

[54] ELECTROPLATING CELL

[75] Inventor: Kenneth M. Dunagan, Oklahoma City, Okla.

[73] Assignees: RKC Corporation, Oklahoma City, Okla.

[21] Appl. No.: 917,112

[22] Filed: Jun. 19, 1978

[51] Int. Cl.[2] ..... C25B 11/02

[52] U.S. Cl. ..... 204/212; 204/272; 204/289

[58] Field of Search ..... 204/212–218, 204/272, 289

[56] References Cited

U.S. PATENT DOCUMENTS

| | | | |
|---|---|---|---|
| 3,560,366 | 2/1971 | Fisher | 204/212 |
| 3,583,897 | 6/1971 | Fulweiler | 204/212 |
| 3,715,299 | 2/1973 | Anderson et al. | 204/212 |

*Primary Examiner*—F. C. Edmundson

*Attorney, Agent, or Firm*—Dunlap, Codding & McCarthy

[57] ABSTRACT

An improved electroplating cell comprising a cathode coaxially aligned with an anode in a solution containing metal ions, the cathode having a plurality of vane sections extending substantially radially therefrom at spaced intervals along the length thereof.

9 Claims, 2 Drawing Figures

ELECTROPLATING CELL

BACKGROUND OF THE INVENTION

1. Field of the Invention

This invention relates generally to improvements in electroplating cells and, more particularly, but not by way of limitation, to an improved electroplating cell having a plurality of vane sections extending substantially radially therefrom at spaced intervals along the length thereof for inducing turbulence in the boundary layer adjacent the cathode.

2. Prior Art Statement

In the electroplating art, it is well known that certain metal ions in solution can be deposited on a negatively-charged surface, commonly referred to as a cathode. For example, in U.S. Pat. No. 2,791,555, issued to Duisenberg et al., it is taught that silver ions can be extracted from used photographic or "hypo" solutions via a plurality of disc-shaped cathodes which are negatively biased relative to a plurality of anode elements. Variations of the disc structure can be seen in the following U.S. Pat. Nos.: 3,342,718, issued to Adams; 3,458,425, issued to Tolle et al.; 3,964,990, issued to Woyden; and 4,049,512, issued to Tolle, Jr.

During the electroplating process, it is well known that a consistent rate of deposition of the metal ions may best be achieved by circulating the metal ion solution past the cathode, thereby replacing the metal ions already plated out on the cathode. In U.S. Pat. Nos. 3,003,942, issued to Cedrone, and 3,964,990, issued to Woyden, pumps are employed to induce the desired fluid circulation. In U.S. Pat. No. 4,049,512, issued to Tolle, Jr., the disc-type cathodes referred to above are provided with impeller surfaces to induce the desired fluid circulation. On the other hand, a plurality of rotating agitators are employed in U.S. Pat. No. 3,477,926, issued to Snow et al. Variations of the agitator structure can be seen in the following U.S. Pat. Nos.: 3,583,897, issued to Fulweiler; 3,806,434, issued to Goold et al.; and U.S. Pat. No. 4,018,658, issued to Alfin et al.

In U.S. Pat. No. 3,715,299, issued to Anderson et al., it is recognized that continuous disturbance of the boundary layer surrounding the cathode structure significantly improves the electroplating process, while discouraging the formation of deleterious by-products. However, the stationary boundary layer trippers proposed therein must extend into close proximity with the cathode surface, thereby limiting the thickness of the deposition layer, as well as discouraging the circulation of solution between the cathode and the trippers. In contrast, the helical vanes taught in U.S. Pat. No. 3,560,366, issued to Fisher induce the desired circulation between the cathode and anode, but are incapable of creating the desired turbulence in the boundary layer. In U.S. Pat. No. 3,551,317, issued to Cooley, it is proposed to solve the boundary layer problem by continually stripping and replacing the entire mass of solution interposed between the anode and cathode.

Other electrolysis apparatus of general interest can be seen in U.S. Pat. Nos. 2,536,912, issued to Corbett, and 2,867,560, issued to Dufour et al.

SUMMARY OF THE INVENTION

The present invention contemplates an improvement in an electroplating cell having a cylindrical anode immersed in a metal ion solution and a coaxial cylindrical cathode rotating in the solution at a pre-determined rate relative to the anode, the cathode being electrically biased at a pre-determined negative voltage relative to the anode. More particularly, the improvement comprises a plurality of turbulence vane sections of substantially helical shape connected to the cathode on the surface thereof disposed adjacent to the anode and extending substantially radially from said surface at spaced intervals along the length thereof.

In a preferred form, longitudinally adjacent turbulence vane sections are positioned in a helical pattern on the surface of the cathode. A plurality of the helical patterns may be provided at spaced intervals around the circumference of the cathode to further encourage the turbulent circulation of the solution along the surface of the cathode.

In one alternate form of the present invention, a plurality of circulating vane sections of substantially helical shape are connected to the cathode on the surface thereof disposed opposite to the anode and extending substantially radially from said surface at spaced intervals along the length thereof. In a preferred form of this embodiment, the circulating vane sections have a reverse curl relative to the turbulence vane sections of the cathode.

It is an object of the present invention to provide an improved electroplating cell wherein a plurality of turbulence vane sections are connected to one surface of a rotating cathode for inducing turbulence in the region of the boundary layer adjacent said surface.

Another object of the present invention is to provide an improved electroplating cell wherein the cathode is provided with a plurality of turbulence vane sections shaped to induce circulation of a metal ion solution along the surface of the cathode generally parallel to the axis thereof.

A further object of the present invention is to provide an improved electroplating cell wherein the cathode has a plurality of turbulence vane sections connected to one surface thereof in a helical pattern for enhancing the flow of a metal ion solution along said surface parallel to the axis of the cathode.

Yet another object of the present invention is to provide an improved electroplating cell wherein the cathode is provided with circulating vane sections at spaced intervals along one other surface thereof, the circulating vane sections being shaped to induce flow of the metal ion solution parallel to the axis of the cathode but in a direction opposite to the direction of flow induced by the turbulence vane sections.

Still another object of the present invention is to provide an improved electroplating cell wherein the cathode is provided with a plurality of helical-shaped turbulence vane sections on the surface thereof disposed adjacent to the anode, and with a plurality of helical-shaped circulating vane sections on the opposite surface thereof, the circulating vane sections cooperating with the turbulence vane sections to enhance the continuous circulation of the metal ion solution between the cathode and the anode in a turbulent manner.

Other objects and advantages of the present invention will be evident from the following detailed description when read in conjunction with the accompanying drawings which illustrate the preferred embodiment of the invention.

DESCRIPTION OF THE PREFERRED EMBODIMENT

Figure 1:
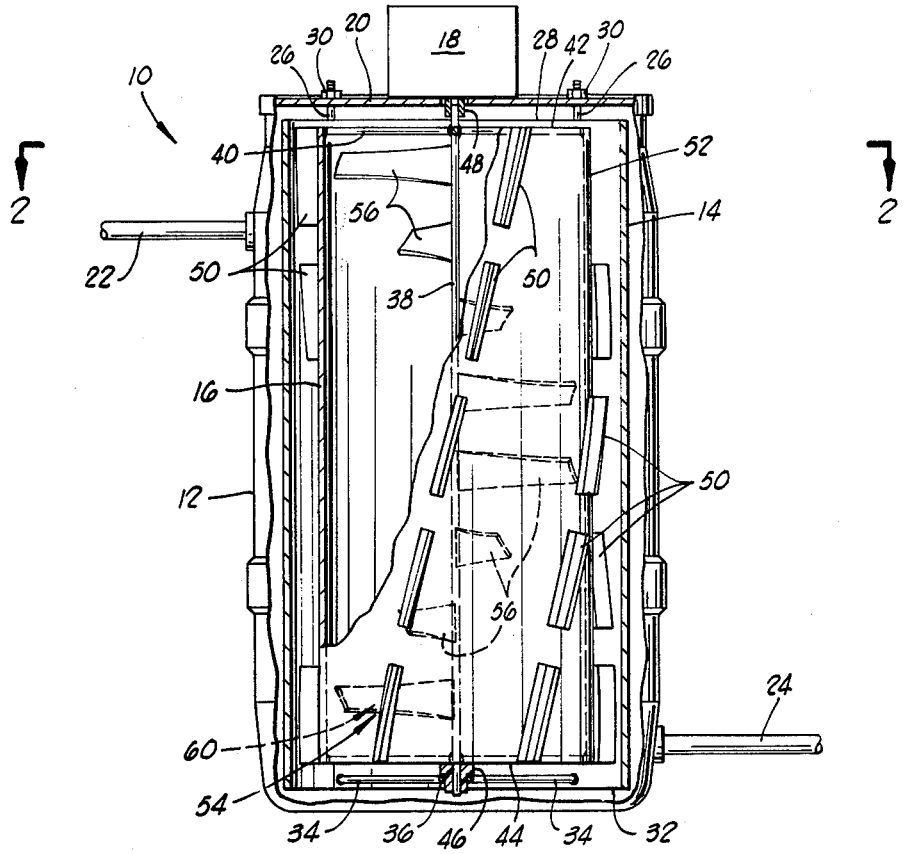
FIG. 1 is a partial-sectional, side elevational view of an electroplating cell constructed in accordance with the preferred embodiment of the present invention.
Figure 2:
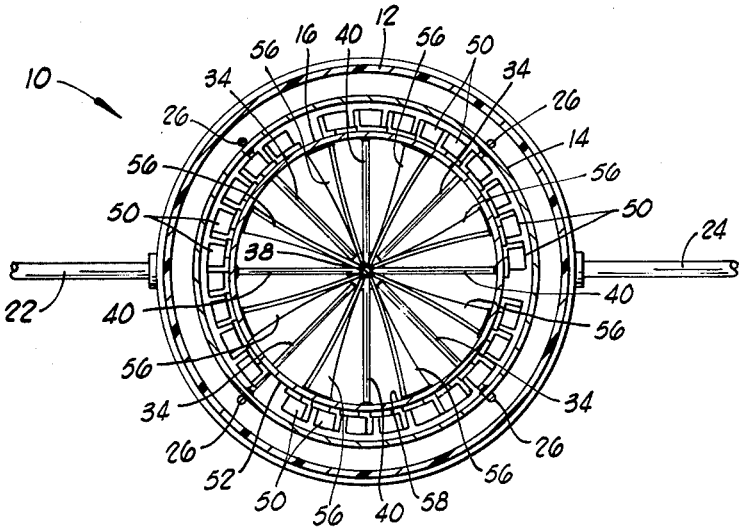
FIG. 2 is a cross-sectional view of the complete electroplating cell shown in FIG. 1 taken along the line 2—2.

Shown in FIGS. 1 and 2 is an electroplating cell 10 constructed in accordance with the preferred embodiment of the present invention. The cell 10 is comprised primarily of a solution container 12, an anode 14, a cathode 16, and a control unit 18. The cell 10 is particularly well adapted for extracting silver ions from used photographic or ∓hypo" solutions, although the apparatus can be employed to extract various metal ions from other solutions.

The solution container 12 is preferably of cylindrical shape and formed of a chemically inert plastic, with a metal top 20 of conventional design. Solution containing the metal ions to be extracted by the cell 10 may be circulated through the solution container 12 via inlet and outlet conduits 22 and 24, respectively, in either a continuous or intermittent manner as desired. It is recommended that filtering apparatus (not shown) be integrated into the circulation path to extract gels and other particulate material which could adversely affect the electroplating process.

The anode 14 is preferably of cylindrical shape and may be electrically and physically connected to the top 20 of the solution container 12 via a plurality of bolts 26 extending upwardly from an upper end 28 thereof through the top 20 into threaded engagement with associated nuts 30. Adjacent to a lower end 32 thereof, the anode 14 is provided with a plurality of spokes 34 extending radially from a center hub 36 of generally annular shape. In the preferred form, the anode 14 is manufactured from a chemically stable metal material such as stainless steel, although other suitable materials will readily occur to those skilled in the art.

The cathode 16 is preferably of cylindrical shape and of lesser diameter than the anode 14. In this form, the cathode 16 may be provided with an axle 38 connected coaxially thereto via a plurality of spokes 40 extending radially between the axle 38 and the cathode 16 adjacent upper and lower ends 42 and 44 thereof. To improve rotary stability of the cathode 16, the axle 38 may be extended downwardly through a plastic bushing 46 disposed through the annular hub 36. Preferably, the cathode 16 is electrically and physically connected to the control unit 18 via the upper end of the axle 38 and a coupling 48 of conventional design. In the preferred form, the cathode 16 is manufactured from a chemically stable metal material such as stainless steel, although other suitable materials will readily occur to those skilled in the art.

The control unit 18 is preferably mounted on the top 20 of the solution container 12 and includes a motor (not shown) for rotating the cathode 16 at a pre-determined rate relative to the anode 14 via the coupling 48. In addition, the control unit 18 includes an electrical circuit of conventional design for electrically biasing the cathode 16 at a pre-determined negative voltage relative to the anode 14, preferably via the coupling 48 to the axle 38 and the bolts 26 extending through the metal top 20.

As can be seen best in FIG. 1, a plurality of turbulence vane sections 50 of substantially helical shape are connected to the cathode 16 on the surface 52 disposed adjacent to the anode 16 at spaced intervals along the length of the cathode 16. As shown in FIG. 2, each of the turbulence vane sections 50 has a portion thereof extending substantially radially from the surface 52 generally toward the anode 14. In the preferred form, longitudinally adjacent turbulence vane sections 50 are positioned in a helical pattern as generally indicated in FIG. 1 via the reference number 54. If desired, the turbulence vane sections 50 can be positioned in a plurality of the helical patterns 54 at spaced intervals around the circumference of the cathode 16. For convenience of manufacturing, it is preferred that the turbulence vane sections 50 be formed of the same material of the cathode 16 and connected thereto in a conventional manner each such as welding.

As can be seen best in FIG. 1, a plurality of circulating vane sections 56 of substantially helical shape may be connected, if desired, to the cathode 16 on the inner surface 58 disposed opposite to the outer service 52, which is disposed adjacent to the anode 14, at spaced intervals along the length of the cathode 16. As shown in FIG. 2, each of the circulating vane sections 56 has a portion thereof extending radially from the surface 58 generally toward the axle 38. Preferably, each of the circulating vane sections 56 has a reverse curl relative to the turbulence vane sections 50, with longitudinally adjacent circulating vane sections 56 being positioned in a helical pattern as generally indicated in FIG. 1 via the reference number 60. Although the circulating vane sections 56 have been shown in the drawings as forming a single helical pattern 60, additional circulating vane sections 56 may be provided if desired to form a plurality of the helical patterns 60. For convenience of manufacturing, it is preferred that the circulating vane sections 56 be formed from the same material as the cathode 16 and connected to extend between the surface 58 and the axle 38 in a convenient manner such as welding.

OPERATION OF THE PREFERRED EMBODIMENT

In operation, the solution container 12 of the electroplating cell 10 will be filled with a suitable metal ion solution, such as used "hypo", so that the anode 14 and the cathode 16 are substantially immersed in the solution. Depending upon the desired manner of operation, the metal ion solution may be continuously circulated through the solution container 12 via the inlet and outlet conduits 22 and 24, respectively, or, alternatively, the solution may be processed in "batches".

Upon actuation, the motor portion of the control unit 18 will initiate rotation of the cathode 16 at a desired pre-determined rate relative to the anode 14 via the coupling 48 to the upper end of the axle 38. The cathode 16 will be maintained substantially coaxial with the anode 14 through the interface between the lower end of the axle 38 and the annular hub 36 via the bushing 46.

Substantially simultaneously, the electrical circuit portion of the control unit 18 will electrically bias the cathode 16 at a desired pre-determined negative voltage relative to the anode 14 via the electrical connections provided by the coupling 48 and the bolts 26. The induced potential difference between the cathode 16 and the anode 14 attracts certain metal ions contained in the solution, such as silver in the case of "hypo", toward the cathode 16. Upon contacting the cathode 16, the metal ions will adhere to the surfaces of the cathode 16 and form a solid plate of the metal on the cathode 16.

In general, the resulting decrease in the concentration of the metal ions in the boundary layer of the solution adjacent to the surfaces of the cathode 16 will substantially retard further plating action. As an alternative to increasing the potential difference between the cathode 16 and the anode 18 and thus the likelihood of other deletrious chemical action, the present invention employs fluid dynamics principles to insure direct exchange of the lower concentration solution comprising the boundary layer with the greater mass of solution retained in the solution container 12. In particular, the turbulence vane sections 50 connected to the cathode 16 at spaced locations on the surface 52 thereof induce circulation of the metal ion solution in both the macro- and micro-systems: the turbulence vane sections 50 are each of substantially helical shape and are preferably positioned to define helical patterns 54 so that, upon rotation of the cathode 16, a general flow of the metal ion solution is encouraged between the anode 14 and the cathode 16; while, simultaneously, the "gaps" or intervals between longitudinally adjacent turbulent vane sections 50 define abrupt discontinuities in the helical patterns 54 thereby producing turbulence "downstream" of the discontinuities which disturbs the boundary layer. The general circulation of the metal ion solution may be further enhanced by providing the circulating vane sections 56 on the opposite surface 58 of the cathode 16, with the reverse curl of the circulating vane sections 56 producing counterflow of the metal ion solution relative to the direction of flow between the cathode 16 and anode 14.

By way of example, it has been determined that the operation of the electroplating cell 10 is particularly effective in reclaiming silver ions from used "hypo" solution when the cathode 16 is rotated at a rate on the order of four revolutions per minute relative to the anode 14. At this rate, an electrical potential on the order of about 1.7 volts dc at an amperage on the order of 1.25 amperes produces an efficient rate of plating. Depending upon variations in the relative dimensions and materials of composition of the cathode 16 and the anode 14, as well as the characteristics of the metal ion solution, other rates of rotation and current density levels may be more effective.

The generally turbulent circulation of the metal ion solution across the surfaces of the cathode 16 produced by the turbulence vane sections 50, an enhanced by the circulating vane sections 56, significantly improves the efficiency of the electroplating cell 10, while minimizing the possibility of undesirable side effects. However, various changes may be made in the construction and arrangement of the various parts or elements of the preferred embodiment as disclosed herein without departing from the spirit and scope of the present invention as defined in the following claims.

What is claimed is:

1. In an electroplating cell having a cylindrical anode immersed in a metal ion solution, and a coaxial cylindrical cathode rotating in the solution at a predetermined rate relative to the anode the cathode being electrically biased at a pre-determined negative voltage relative to the anode, the cathode having an outer cathode surface disposed adjacent to the anode and having an opposite inner cathode surface, the improvement comprising:

a plurality of turbulence vane sections of substantially helical shape connected to the outer cathode surface at spaced intervals along the length of the cathode, with each turbulence vane section having a portion thereof extending substantially radially from said surface generally toward the anode.

2. The cell of claim 1 wherein longitudinally adjacent turbulence vane sections are positioned in a helical pattern on said surface.

3. The cell of claim 2 wherein the turbulence vane sections are positioned in a plurality of the helical patterns at spaced intervals around the outer circumference of the cathode.

4. The cell of claim 3 wherein the cathode has a plurality of circulating vane sections of substantially helical shape connected to the inner cathode surface at spaced intervals along the length of the cathode, with each circulating vane section having a portion thereof extending radially from said inner cathode surface at a reverse curl relative to the turbulence vane sections.

5. The cell of claim 4 wherein the cathode includes an axle extending coaxially through the cathode, the circulating vane sections extending radially inwardly into connection with the axle at spaced intervals therealong.

6. The cell of claim 1 wherein the cathode has a plurality of circulating vane sections of substantially helical shape connected to the inner cathode surface at spaced intervals along the length of the cathode, with each circulating vane section having a portion thereof extending radially from said surface at a reverse curl relative to the turbulence vane sections.

7. The cell of claim 6 wherein the circulating vane sections are positioned in a helical pattern.

8. The cell of claim 7 wherein the cathode includes an axle extending coaxially through the cathode, the circulating vane sections extending radially inwardly into connection with the axle at spaced intervals therealong.

9. In an electroplating cell having a cylindrical anode immersed in a metal ion solution, and a coaxial cylindrical cathode rotating in the solution at a predetermined rate relative to the anode, the cathode being electrically biased at a pre-determined negative voltage relative to the anode and having an outer surface disposed adjacent to the anode and an opposite inner surface, the improvement comprising:

a plurality of turbulence vane sections of substantially helical shape connected to the outer cathode surface along the length of the cathode, with each turbulence vane section having a portion thereof extending substantially radially from the outer cathode surface generally toward the anode, the turbulence vane sections disposed in spaced apart relationship and with longitudinally adjacent turbulence vane sections forming a plurality of helical patterns on the cathode outer surface; and a plurality of circulating vane sections of substantially helical shape connected to the inner cathode surface at spaced intervals along the length of the cathode, with each circulating vane section having a portion thereof extending radially from said surface at a reverse curl relative to the turbulence vane sections, the circulating vane sections positioned in a helical pattern.

* * * * *

UNITED STATES PATENT OFFICE

CERTIFICATE OF CORRECTION

Patent No. 4,169,033 Dated September 25, 1979

Inventor(s) Kenneth M. Dunagan

It is certified that error appears in the above-identified patent and that said Letters Patent are hereby corrected as shown below:

Column 3, line 18, ∓hypo" should be --"hypo"--.

Column 4, line 5, insert the word --outer-- between "the" and "surface".

Column 5, line 51, "an" should be --as--.

Signed and Sealed this

*Eighteenth* Day of *December 1979*

[SEAL]

*Attest:*

SIDNEY A. DIAMOND

*Attesting Officer*

*Commissioner of Patents and Trademarks*